US005372523A

United States Patent [19]

Sakatani et al.

[11] Patent Number: 5,372,523

[45] Date of Patent: Dec. 13, 1994

[54] BODY MOUNTING TYPE ELECTRICAL CONNECTOR

[75] Inventors: Athushi Sakatani; Nobuyosi Tanaka, both of Yokkaichi, Japan

[73] Assignee: Sumitomo Wiring Systems, Ltd., Yokkaichi, Japan

[21] Appl. No.: 65,744

[22] Filed: May 24, 1993

[30] Foreign Application Priority Data

May 29, 1992 [JP] Japan ..... 4-036503[U]

[51] Int. Cl.[5] ..... H01R 13/74

[52] U.S. Cl. ..... 439/552; 439/557

[58] Field of Search ..... 439/552, 557, 536, 544, 439/562, 571

[56] References Cited

U.S. PATENT DOCUMENTS 2,891,103 6/1959 Swengel .
3,523,269 8/1970 Witek et al. ..... 439/557 X
3,530,426 9/1970 Snyder, Jr. .
3,989,343 11/1976 Lucius et al. .
3,998,518 12/1976 Mathe .
4,541,036 9/1985 Landries et al. ..... 439/557 X

FOREIGN PATENT DOCUMENTS 0147828 7/1985 European Pat. Off. .
1665408 3/1971 Germany .
52-92391 8/1977 Japan .
60-99789 7/1985 Japan .

*Primary Examiner*—Eugene F. Desmond
*Attorney, Agent, or Firm*—Sandler Greenblum & Bernstein

[57] ABSTRACT

A body mounting type electrical connector comprising: a hood which is provided at one end portion of the electrical connector and is formed with an opening for receiving a mating electrical connector; a housing for accommodating a plurality of terminals, which is provided at the other end portion of the electrical connector; the electrical connector being inserted into a mounting hole of a body member from a distal end of the hood so as to project the distal end of the hood out of an outer surface of the body member such that the electrical connector is mounted on the body member; a hook portion which, when the mating electrical connector is inserted into the opening of the electrical connector initially from one of upper and lower portions of a distal end of the mating electrical connector, is provided at a corresponding one of upper and lower portions of the distal end of the hood so as to be engaged with an inner surface of the body member; and a flexible lock which is provided at the other of the the upper and lower portions of the distal end of the hood so as to be engaged with the outer surface of the body member.

4 Claims, 2 Drawing Sheets

BODY MOUNTING TYPE ELECTRICAL CONNECTOR

BACKGROUND OF THE INVENTION

The present invention generally relates to body mounting type electrical connectors to be mounted on a body member and more particularly, to a body mounting type electrical connector which is fixed, at a split portion between, for example, a door of a motor vehicle and a vehicle body, to a body of the door or the vehicle body and then, is coupled with a mating electrical connector so as to be securely locked to the body of the door or the vehicle body.

As shown in FIG. 1, a known body mounting type electrical connector 1 of this kind is substantially of a shape of a rectangular parallelepiped and includes a hood 1*b* formed with a rectangular opening 1*a* for receiving a mating electrical connector 3 (FIG. 2*a*) which is also generally of a shape of a rectangular parallelepiped. A pair of retainer plates 1*c* engageable with a body member 2 project outwardly from upper and lower walls of the hood 1*b*, respectively. Flexible locks 1*d* and 1*e* are formed by arms extending axially rearwardly in a tapered shape from front edges of the upper and lower walls of the hood 1*b* at a front end of the opening 1*a*, respectively. Pawl portions 1*d*' and 1*e*' project outwardly orthogonally to the upper and lower walls of the hood 1*b* at rear ends of the flexible locks 1*d* and 1*e*, respectively.

The body member 2 has a mounting hole 2*a* for receiving the hood 1*b* of the electrical connector 1 and is disposed at a center between inside and outside panels (not shown). When the electrical connector 1 is inserted into the mounting hole 2*a* from an inside X of the body member 2 in the direction of the arrow A, the flexible locks 1*d* and 1*e* are deflected so as to project into an outside Y of the body member 2. Thus, the pawl portions 1*d*' and 1*e*' of the flexible locks 1*d* and 1*e* are brought into contact with an outer surface 2*b* of the body member 2 so as to be retained by the outer surface 2*b*. At the same time, the retainer plates 1*c* are brought into contact with an inner surface 2*c* of the body member 2 so as to be retained by the inner surface 2*c*. As a result, the body member 2 is gripped between the retainer plates 1*c* and the flexible locks 1*d* and 1*e* such that the electrical connector 1 is secured to the body member 2.

When the mating electrical connector 3 is coupled with the electrical connector 1 secured to the body member 2 beforehand, clearance between the body member 2 and the outside panel is small, thereby resulting in little space for inserting the mating electrical connector 3.

Therefore, when the mating electrical connector 3 is coupled with the electrical connector 1, the mating electrical connector 3 cannot be aligned with the electrical connector 1 but should be inserted into the opening 1*a* obliquely from above or from below the electrical connector 1 as shown in FIG. 2*a*. In this case, a front end of the mating electrical connector 3 depresses the projecting flexible lock 1*d* so as to deflect the flexible lock 1*d* such that the flexible lock 1*d* is disengaged from the body member 2. When the flexible lock 1*d* has been disengaged from the body member 2 as described above, the electrical connector 1 is inclined as shown in FIG. 2*b* and thus, the flexible lock 1*e* is also disengaged from the body member 2. As a result, the electrical connector 1 drops from the body member 2. Consequently, such a problem arises that the electrical connector 1 drops inside the door and cannot be taken out of the door easily.

SUMMARY OF THE INVENTION

Accordingly, an essential object of the present invention is to provide, with a view to eliminating the disadvantages inherent in conventional body mounting type electrical connectors, a body mounting type electrical connector which not only is positively secured to a body member so as not be disengaged from the body member even if an end portion of the electrical connector is depressed by a front end of a mating electrical connector inserted obliquely relative to the electrical connector but can be easily inserted into a mounting hole of the body member.

In order to accomplish this object of the present invention, a body mounting type electrical connector which is mounted on a body member so as to be coupled with a mating electrical connector, according to the present invention comprises: a hood which is provided at one end portion of the electrical connector and is formed with an opening for receiving the mating electrical connector; a housing for accommodating a plurality of terminals, which is provided at the other end portion of the electrical connector; the electrical connector being inserted into a mounting hole of the body member from a distal end of the hood so as to project the distal end of the hood out of an outer surface of the body member such that the electrical connector is mounted on the body member; a hook portion which, when the mating electrical connector is inserted into the opening of the electrical connector initially from one of upper and lower portions of a distal end of the mating electrical connector, is provided at a corresponding one of upper and lower portions of the distal end of the hood so as to be engaged with an inner surface of the body member; and a flexible lock which is provided at the other of the the upper and lower portions of the distal end of the hood so as to be engaged with the outer surface of the body member.

Namely, in case the mating electrical connector is obliquely downwardly inserted into the opening of the electrical connector, the hook portion is provided at the upper portion of the distal end of the hood and the flexible lock is provided at the lower portion of the distal end of the hood. On the contrary, in case the mating electrical connector is obliquely upwardly inserted into the opening of the electrical connector, the hook portion is provided at the lower portion of the distal end of the hood and the flexible lock is provided at the upper portion of the distal end of the hood.

Meanwhile, it is desirable that a pair of further flexible locks be provided at opposite sides of the corresponding one of the upper and lower portions of the distal end of the hood such that the hook portion is laterally disposed between the further flexible locks.

Since the hook portion is provided at the distal end of the hood of the electrical connector so as to be engaged with the inner surface of the body member as described above, the mating electrical connector does not come into contact with the further flexible locks disposed at the opposite sides of the distal end of the hook portion. As a result, such a phenomenon can be prevented that the electrical connector is detached from the body member upon contact of the distal end of the mating electrical connector with the further flexible locks.

BRIEF DESCRIPTION OF THE DRAWINGS

This object and features of the present invention will become apparent from the following description taken in conjunction with the preferred embodiment thereof with reference to the accompanying drawings, in which.

DETAILED DESCRIPTION OF THE INVENTION

Figure 1:
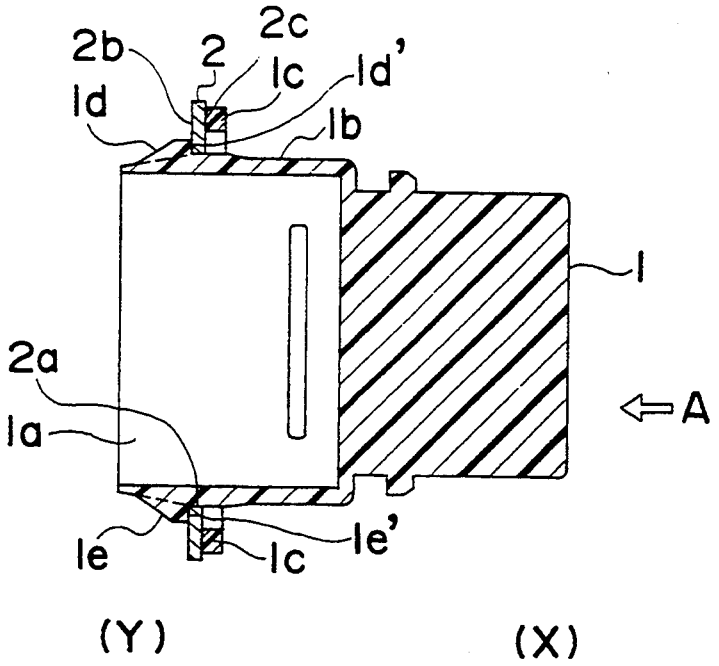
Fig. 1 PRIOR ART
FIG. 1 is a sectional view of a prior art body mounting type electrical connector to be mounted on a body member (already referred to)
Figure 2A:
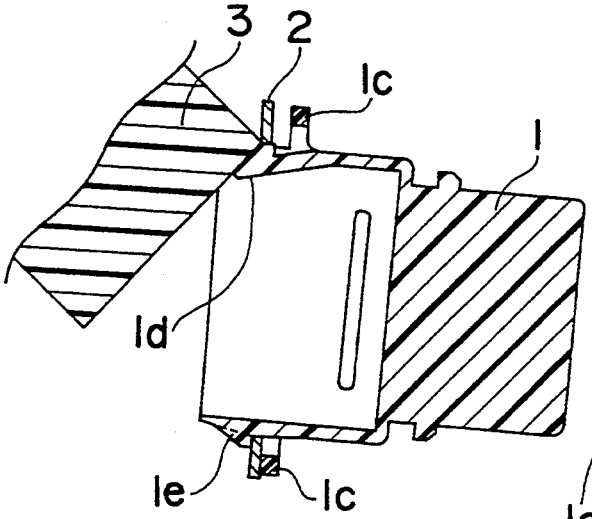
Fig. 2a PRIOR ART
FIGS. 2*a* and 2*b* are sectional views indicative of a drawback of the prior art electrical connector of FIG. 1 (already referred to)
Figure 2B:
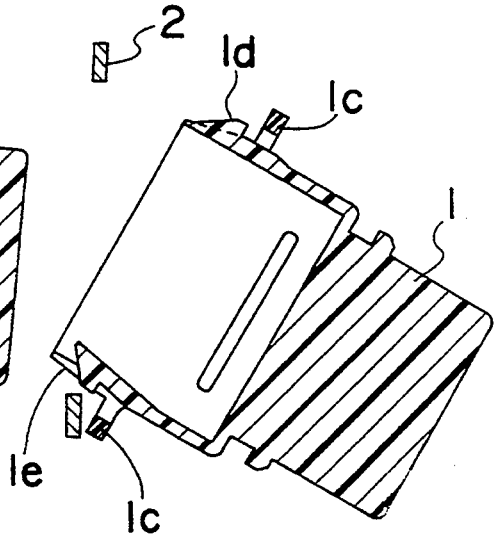
Fig. 2b PRIOR ART
Figure 3:
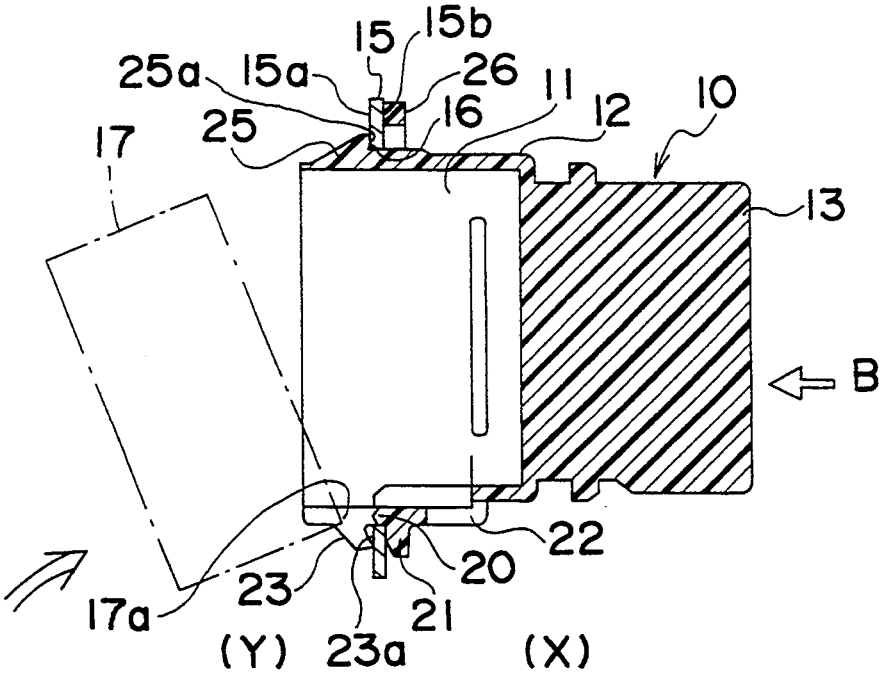
FIG. 3 is a sectional view showing a body mounting type electrical connector mounted on a body member, according to the present invention.
Figure 4A:
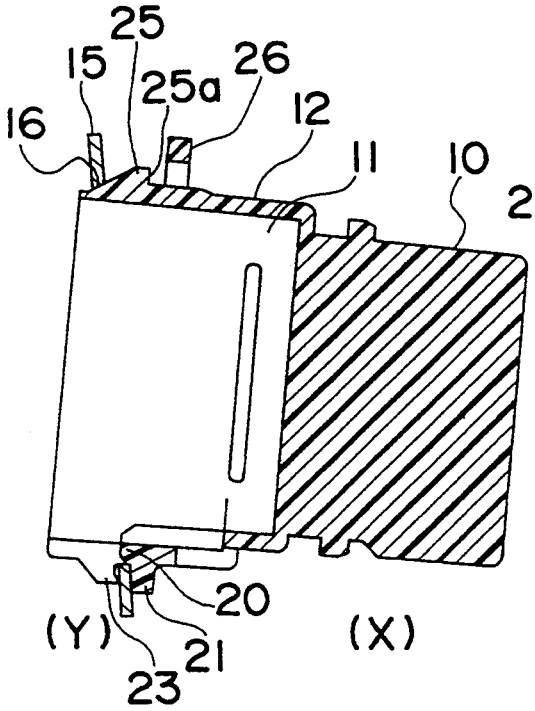
FIGS. 4*a* and 4*b* are sectional views showing steps of mounting the electrical connector of FIG. 3 on the body member.
Figure 4B:
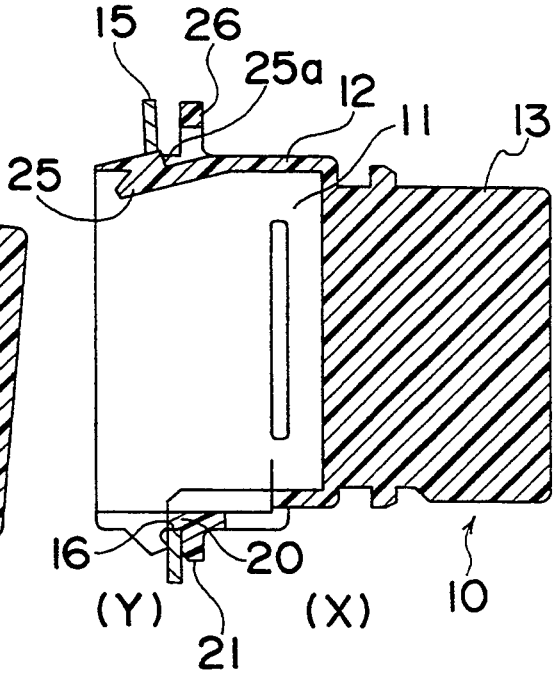

Referring now to the drawings, there is shown in FIGS. 3, 4*a* and 4*b*, a body mounting type electrical connector 10 to be mounted on a body 15 of a door of a motor vehicle, according to one embodiment of the present invention. The electrical connector 10 is substantially of a shape of a rectangular parallelepiped and a mating electrical connector 17 to be coupled with the electrical connector 10 is also generally of a shape of a rectangular parallelepiped. A hood 12 is provided at one end of the electrical connector 10 and has a rectangular opening 11 for receiving the mating electrical connector 17. Meanwhile, a housing 13 for accommodating multipolar terminals (not shown) is provided at the other end of the electrical connector 10. The hood 12 is inserted into a mounting hole 16 of the door body 15 from an inside X of the door body 15 to an outside Y of the door body 15 in the direction of the arrow B such that the electrical connector 10 is secured to the door body 15. Then, as shown by the one-dot chain line in FIG. 3, the mating electrical connector 17 is obliquely upwardly fitted into the opening 11 of the electrical connector 10 secured to the door body 15. At a front end of a lower wall of the hood 12, the electrical connector 10 has a front end portion 20 engageable with a lower portion of a peripheral surface of the mounting hole 16 of the door body 15 and an L-shaped hook portion 21 extending rearwardly from the front end portion 20 towards the housing 13. A recess 22 is formed rearwards of the hook portion 21 so as to impart elasticity to the hook portion 21.

The hook portion 21 extends through the front end of the lower wall of the hood 12. Meanwhile, a pair flexible locks 23 each having a pawl 23*a* engageable with an outer surface 15*a* of the door body 15 are formed at opposite sides of the lower wall of the hood 12 so as to project outwardly from the mounting hole 16 of the door body 15. Thus, at the lower wall of the hood 12, the hook portion 21 disposed at a central portion of the lower wall of the hood 12 is engaged with an inner surface 15*b* of the door body 15, while the pawls 23*a* of the flexible locks 23 are engaged with the outer surface 15*a* of the door body 15. Therefore, at the lower wall of the hood 12, the hook portion 21 and the flexible locks 23 of the electrical connector 10 are engaged with the door body 15 alternately in the lateral direction of the electrical connector 10, i.e., in the direction orthogonal to the drawing sheet.

Meanwhile, a flexible lock 25 is formed at a front end of an upper wall of the hood 12 and recesses are formed at opposite sides of the flexible lock 25, respectively. The flexible lock 25 is formed by an arm extending in a tapered shape rearwardly from an upper face of the front end of the hood 12. A rear end face of the flexible lock 25 acts as a locking pawl 25*a* engageable with the outer surface 15*a* of the door body 15. At a location spaced rearwardly a distance equal to a thickness of the door body 15 from the flexible lock 25, a retainer plate 26 projects upwardly from the upper wall of the hood 12 and laterally extends through the upper wall of the hood 12 so as to be engaged with the inner surface 15*b* of the door body 15.

When the electrical connector 10 is mounted on the door body 15, clearance between the door body 15 and an inside panel (not shown) is small and thus, the electrical connector 10 is obliquely upwardly inserted into the mounting hole 16 of the door body 15 as shown in FIGS. 4*a* and 4*b*. Initially, as shown in FIG. 4*a*, the front end of the lower wall of the hood 12 is passed through the mounting hole 16 and the hook portion 21 is engaged with a lower portion of the inner surface 15*b* of the door body 15. In this state, the flexible lock 25 projecting upwardly from the upper wall of the hood 12 is brought into contact with a peripheral edge of the mounting hole 16 of the door body 15. Thus, the flexible lock 25 is deflected downwardly as shown in FIG. 4*b* so as to pass through the mounting hole 16. When the flexible lock 25 reaches the outside Y of the door body 15, the flexible lock 25 assumes the original shape due to its elasticity so as to project upwardly. Therefore, as shown in FIG. 3, the door body 15 is gripped between the locking pawl 25*a* of the flexible lock 25 and the retainer plate 26 such that the electrical connector 10 is locked to the door body 15.

The electrical connector 10 is secured to the door body 15 as described above and the flexible locks 23 are disposed at the opposite sides of the lower wall of the hood 12. Therefore, at the central portion of the lower wall of the hood 12, no flexible lock projecting downwardly from the door body 15 is provided and only the hook portion 21 is provided so as to be engaged with the inner surface 15*b* of the door body 15. Thus, even if the mating electrical connector 17 is obliquely upwardly inserted into the opening 11 of the electrical connector 10 as shown in FIG. 3, a lower edge 17*a* of the mating electrical connector 17 is not brought into contact with the electrical connector 10. Accordingly, it is possible to positively prevent such a phenomenon that at the time of insertion of the mating electrical connector 17 into the opening 11 of the electrical connector 10, the electrical connector 10 is detached from the door body 15 and drops from the door body 15.

Meanwhile, in case the mating electrical connector 17 should be obliquely downwardly inserted into the opening 11 of the electrical connector 10, the arrangement of the electrical connector 10 shown in FIG. 3 may be reversed, namely, the hook portion 21 is provided on the upper wall of the hood 12 and the flexible lock 25 is provided on the lower wall of the hood 12.

As is clear from the foregoing description, when the mating electrical connector 17 is fitted into the opening 11 of the electrical connector 10 secured to the door body 15, it is possible to prevent the electrical connector 10 from being detached from the door body 15 even if the electrical connector 10 is depressed by the mating electrical connector 17. Therefore, in accordance with the present invention, the electrical connector 10 can be securely fixed to the door body 15. Furthermore, since the electrical connector 10 is quite structurally simple, the electrical connector 10 can be produced at low cost.

What is claimed is:

1. A body mounting type electrical connector which is mounted on a body member so as to be coupled with a mating electrical connector, comprising:

a hood which is provided at one end portion of the electrical connector and is formed with an opening for receiving the mating electrical connector;

a housing for accommodating a plurality of terminals, which is provided at the other end portion of the electrical connector;

the electrical connector being inserted into a mounting hole of the body member from a distal end of the hood so as to project the distal end of the hood out of an outer surface of the body member such that the electrical connector is mounted on the body member;

a substantially fixed hook portion which, when the mating electrical connector is inserted into the opening of the electrical connector initially at one of upper and lower portions of a distal end of the mating electrical connector, is provided at a corresponding one of upper and lower portions of the distal end of the hood so as to be engaged with an inner surface of the body member at an engagement portion; and a flexible lock which is provided at the other of the upper and lower portions of the distal end of the hood so as to be engaged with the outer surface of the body member, whereby when the electrical connector is inserted into the mounting hole, the electrical connector pivots about the engagement portion until the flexible lock engages the outer surface of the body member.

2. A body mounting type electrical connector as claimed in claim 1, further comprising:

an engageable portion which is provided at the hook portion so as to be engaged with a peripheral surface of the mounting hole of the body member.

3. A body mounting type electrical connector as claimed in claim 2, further comprising:

a pair of further flexible locks which are provided at opposite sides of the corresponding one of the upper and lower portions of the distal end of the hood so as to be engaged with the outer surface of the body member.

4. A body mounting type electrical connector as claimed in claim 3, wherein said substantially fixed hook portion is located between said pair of further flexible locks.

* * * * *

UNITED STATES PATENT AND TRADEMARK OFFICE

CERTIFICATE OF CORRECTION

PATENT NO. : 5,372,523

DATED : Dec. 13, 1994

INVENTOR(S) : Athushi Sakatani et al.

It is certified that error appears in the above-indentified patent and that said Letters Patent is hereby corrected as shown below:

On the title page, item : [57], line 19 of the abstract, change "the the" to ---the---.

At column 3, line 56, change "pair" to ---pair of---.

Signed and Sealed this

Fifth Day of November, 1996

*Attest:*

Bruce Lehman

BRUCE LEHMAN

*Attesting Officer*

*Commissioner of Patents and Trademarks*